United States Patent [19]

Angileri

[11] Patent Number: 4,746,126

[45] Date of Patent: May 24, 1988

[54] COMBINATION CRAPS AND CARD GAME

[76] Inventor: Benjamin T. Angileri, 1357 Box Canyon Rd., San Jose, Calif. 95120

[21] Appl. No.: 828,843

[22] Filed: Feb. 12, 1986

[51] Int. Cl.[4] ..... A63F 3/00

[52] U.S. Cl. ..... 273/249; 273/274

[58] Field of Search ..... 273/256, 243, 274, 249, 273/273, 248, 236, 242, 250, 251, 252, 253, 256, 257, 258

[56] References Cited

U.S. PATENT DOCUMENTS

| | | | |
|---|---|---|---|
| 779,229 | 1/1905 | Mansfield | 273/249 |
| 1,490,153 | 4/1924 | Wischhusen et al. | 273/249 |
| 3,104,106 | 9/1963 | Kenney et al. | 273/249 |
| 3,399,897 | 9/1968 | Mitchell | 273/274 X |
| 3,779,555 | 12/1973 | Wimberly | 273/249 |
| 3,889,954 | 6/1975 | Malisow | 273/256 |
| 4,089,527 | 5/1978 | Roth | 273/273 X |

*Primary Examiner*—Matthew L. Schneider

*Attorney, Agent, or Firm*—Thomas S. MacDonald; Alan H. MacPherson; Paul J. Winters

[57] ABSTRACT

A game board utilizes and teaches the basic playing and wagering parameters of a casino craps game while challenging player against player in strategic card play. The game board includes series of wagering areas before each player simulating betting areas on the casino craps table, a central pot area and a ladder-like token step advance area. The play of cards, equally dealt to the players from a standard deck, is dependent on the same throw(s) of dice as is the craps wagering play. Movement of a token is dependent on the possible discard after each throw of dice of one or more cards of a value or values reflecting the sum of the dice indicia on the thrown dice. Winning wagers or rewards are paid from a central pot area on the board from antes of the players and from previous lost wagers which are placed in the central pot area. The winner may either be the player or partnership able to first discard all its cards or move his token to the central area along the token ladder.

10 Claims, 2 Drawing Sheets

© 1986 B. Angileri

COMBINATION CRAPS AND CARD GAME

A portion of the disclosure of this patent document contains material which is subject to copyright protection. The copyright owner has no obligation to the facsimile reproduction by anyone of the patent document or the patent disclosure, as it appears in the Patent and Trademark Office patent file or records, but otherwise reserves all coypright rights whatsoever.

BACKGROUND OF THE INVENTION

1. Field of the Invention

The present invention is directed to a combined dice and card game board which may be used as a parlor game and as a teaching aid for the somewhat complicated casino game of craps popularized in the states of Nevada and New Jersey. More particularly, the game board combines the excitement of casino craps with the challenge of strategic card play using a 52-card deck of standard bridge or poker cards. An optional feature of the game board incorporates movable markers or tokens which are advanced to a central pot position with the first player reaching the central pot position collecting chips previously placed in the central pot position and ending the game in accordace with game rules.

2. Description of Material Art

Several different games utilize game boards involving variants of craps or the actual casino craps format. U.S. Pat. Nos. 1,669,470; 3,829,098; 4,247,114; 4,312,508; 4,334,685; 4,346,900; and 4,364,567 all illustrate various dice/wagering board games. U.S. Pat. No. 4,443,012 shows a card and dice game in which a pack of special dice-marked cards are employed and British Patent No. 1,348,632 employs a standard pack of cards with wagers being placed on card numbers Ace to King and on card suits with a roulette-type board format without the use of dice.

SUMMARY OF THE INVENTION

The present invention gives each player various opportunities to win the game played on the game board utilizing not only the luck of a roll of dice but also employing the challenge of strategic card play not dictated solely by a dice roll. Generally, the amateur, starting or a very occasional casino player, avoids the craps table at a casino due to the complexity of the craps game and the difficulty of quickly picking up the play from casual observation especially around a crowded table. The game board described below allows one to learn and practice the basic rules of casino craps as practiced in the States of Nevada and New Jersey in a game of fun and relaxation with the excitement of real casino action. The game can be played by two to eight players.

The object of the game as played on the game board or individual segments of the board is to be the first player to discard all cards held in a player's hand during each round of play and to accumulate as many chips as possible resultant from the placement of wagers and the roll of the dice. In the preferred mode of play, according to the Rules of Play, the overall game is played until a player's token enters a central pot area of the game board where various wagers and lost wagers are accumulated and paid out to players. Roll of the dice and initial chip wagering and wager odds and rewards are generally in accord with the basic rules of casino craps. In addition, however, each roll of the dice instigates play of a standard deck of cards which has been shuffled and the cards equally distributed to the players. Upon each total dice sum being exposed to view, each player must discard a card or cards with a number or numbers totalling that dice sum. In the game, an Ace is considered a "1" card. Jacks, Queens and Kings are considered alone as "10", "11" or "12" cards and are not combinable. Cards "2" through "9" are used at face value.

In a preferred mode of play, the game board also incorporates a step ladder with use of a token or marker assigned to each player which, upon the coincidence of (1) a certain fundamental casino craps wager, i.e. a pass-line wager, and (2) the first (come out) roll of craps, i.e. a sum total of 7 or 11 on the two dice or upon a player discarding all his cards, is moved in a series of steps toward the central pot area leading to a winning position if that player reaches that area before the other players. This also results in the end of the game.

Thus, it is seen that a combined casino craps dice game and standard card play game is playable with the game board with or without a movement of player tokens. The game normally takes about an hour to play which is a satisfactory time span for a recreational parlor game. The game may be played so that participants ante, wager and win or lose as individuals or as a partnership with another player where they play against other two-person partnerships.

DETAILED DESCRIPTION

Figure 1:
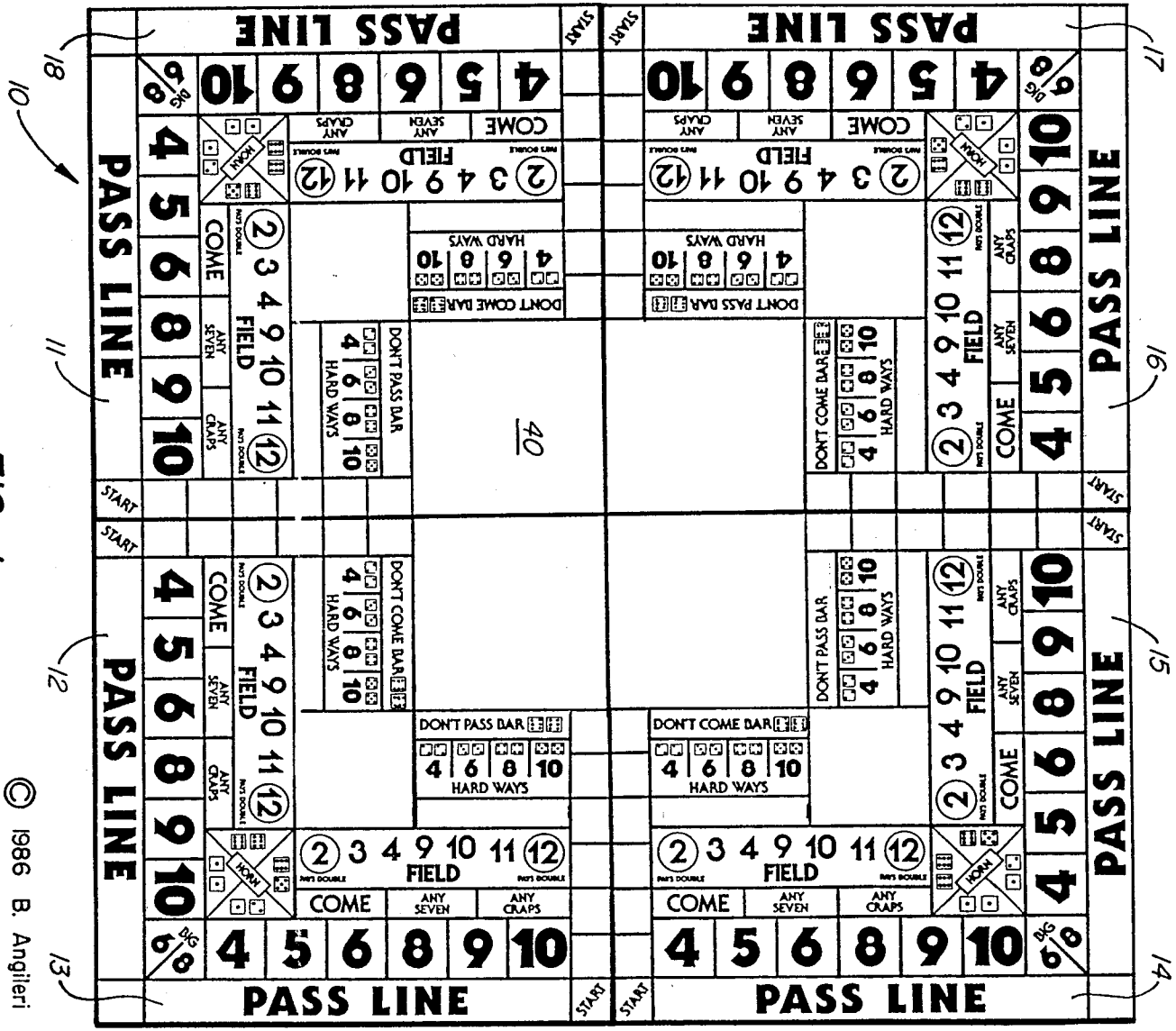
FIG. 1 is a plan view of the preferred embodiment of the game board.

As seen in FIG. 1, a flat game board 10 normally of square or rectangular configuration includes a first series of essentially eight playing areas 11 through 18 on an upper playing surface before which each player sits. If less than eight players are involved, say four, then each player will have a whole quarter segment of the board, e.g. both playing areas 11 and 12 for his use. If two players are involved, each player may utilize half of the board, e.g. playing areas, 18, 11, 12 and 13.

Figure 2:
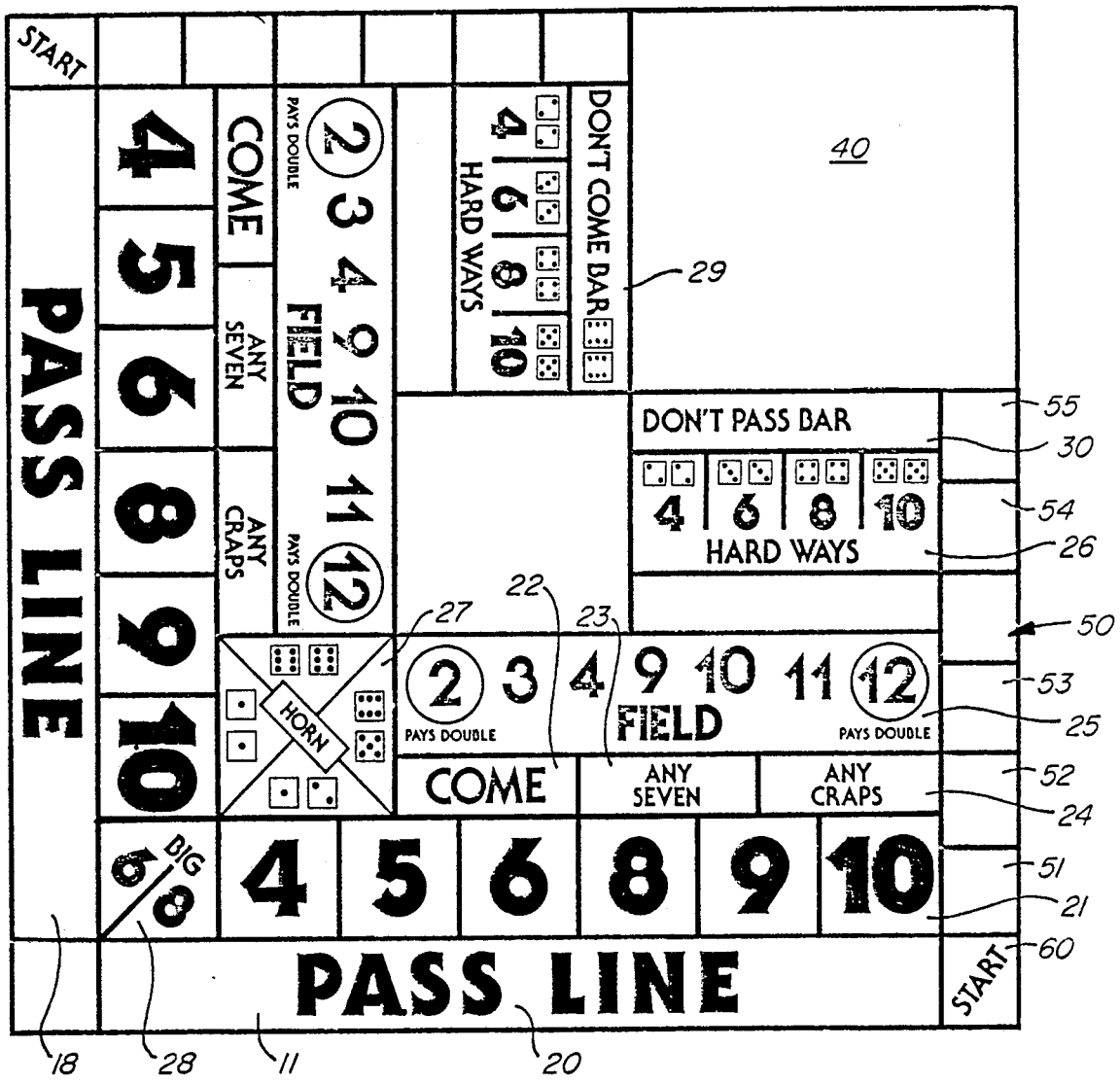
FIG. 2 is a plan view of one of the four duplicative portions of the game board.

Each of a first series of playing areas include wagering squares or areas associated with casino craps. These are seen in FIG. 2 in a magnified view of player areas 11 and 18. The wagering areas include the PASS LINE 20; PLACE BET squares 21 numbered, 4, 5, 6, 8, 9 and 10; a COME square 22; an ANY SEVEN area 23; an ANY CRAPS area 24; a FIELD area 25 for special wagers on any throw of the dice; a HARD WAYS area 26 for a specific combination of dice indicia; a HORN area 27 common to adjoining positions 11, 18 et al. inward from the four corners of the overall game board for die configurations of 2, 3, 11 and 12; a BIG 6/8 area 28 for any total of four or eight on the dice, also common to adjoining playign positions e.g. 11 and 18 and adjacent to the board corners; a DON'T COME BAR area 29; and DON'T PASS BAR area 30 each common to adjoining playing positions e.g. 11 and 18. Each of the wagering areas 20 through 30 have an imprinted numeral or other dice indicia of the numbers 2 through 12 thereon which are to be matched by a winning throw of the dice. The game board also includes a central pot area 40 common to all playing areas.

The numbers of dots on the top surfaces of the thrown dice are summed and that is the number on which wagers are won or lost as is known in the game of casino craps. Each of the wagering areas has a set reward at particular "odds" which for the purpose of this recreational and teaching aid game have been simplified in accordance with game rules. Each player initially is given a prescribed number of different colored chips, such as red, white, and blue poker chips to spend on his subsequent wagers and antes. Particular values are assigned to the color of the chip - 1 point for white, 2 points for red and 5 points for blue.

In conjunction with the casino craps part of the game board, a card game is simultaneously played which also depends on the smae throw of the dice as in the wagering craps portion. This not only creates more challenge in having strategic card play involved but determines in one embodiment of the game, the completion of the game or one increment of the game. A pack of conventional standard playing cards with four suits and numbered Ace through the King as typically used in the game of bridge or poker are employed.

Each player is dealt an equal number of cards, for example, in a four player game each player is given thirteen cards. On each roll of the dice every player is allowed to discard a card or cards which individually or collectively add up to the sum of the indicia on the top surfaces of the two dice when the dice come to rest on a flat surface. For example, if the dice sum is "8", two cards marked "2" and "6" or a card marked "8" or three cards marked "1", "3" and "4", all adding up to "8" may be discarded. A card numbered 10 is a "10" while the Jacks, Queens and Kings are all considered "10" or "11" or "12" cards and may be discarded alone if a "10", "11" or "12" is the dice sum thrown. If a player cannot discard one or more cards equal to the dice sum thrown, the player must put a chip of prescribed value into a central pot area 40. If a player decides he does not wish to continue the particular round of play, for example when his remaining cards are unlikely to be useful in matching future dice throws, the player may withdraw by placing an extra chip or prescribed number of chips in the central pot area. The first player to discard all his cards is the winner of the chips in the central pot area. Contributions to the central pot, i.e., an ante, are made by each player before each round of play before the cards are dealt. Also, all lost wagers in the casino craps portion of the game are forfeited to the central pot and are "won" by the player first discarding all his or her cards. Winning craps wagers are paid from the central pot.

A third aspect of the game board is the provision of a second series of discretely marked linearly extending playing areas or token ladder 50 extending from a START square 60 to the central pot area 40, in six, more or less, step increments 51 through 55. The ladders 50 extend in side-by-side pairs between sets of wagering areas, e.g. between the 11/18 areas and the 12/13 areas, from adjacent the periphery of the game board at the midpoint of each side of the game board to the center pot area 40. Each player has a token which is initially placed in START square 60. On the first roll of dice by a particular player, i.e., the "come out" roll in casino parlance, if a "7" or "11" is rolled on the sum of the two dice, all players with PASS LINE bets can advance their token one box first to block 51. In succeeding wins on come out rolls and PASS LINE bets the token is moved to block 52, etc., until a player reaches central pot area 40. At this time the overall game ends and that person collects the chips then in the central pot. The player who first discards all his or her cards also may advance his or her token one square provided a PASS LINE bet has been made on wagering area 20. At the end of the game the overall winner is the person or partnership with the highest total point value of chips.

Additional accoutrements or paraphernaila useful in the playing of the game, in addition to the pack of cards, dice, chips, tokens and game board, are two white pass line number markers or pucks; a chip loan receipt pad; and Rules of the Game.

RULES OF THE GAME

©1986 B.T. ANGILERI

There are many rounds of play during the overall game. The game is played until a player's token enters the center square, this takes seven moves of the token. At this point the overall game ends and the player or partners (if you are playing partner play) with the highest total point value of chips win.

1. Each player is given an equal amount of chips. Ten white, ten red and ten blue. White chips have a point value of One. Red chips have a point value of Two and Blue chips have a point value of Five.

2. Each player in rotation throws the dice. After a process of elimination the player with the highest number thrown on the dice is chosen as the initial card dealer and first dice roller. Each new card dealer is the player to the left of the last dealer. Each new dice roller is the first player to discard all cards in the last round of play.

3. Starting with the dice roller, each player, in rotation antes up one white chip into the center square in the center of the board. The reason for the ante is to have enough chips in the center square to cover all the Craps wins made by the player during each round of play. If at any time during the game there are not enough chips in the center sqaure to play off craps win bets, then each player must ante up equally until there are enough chips in the center square to pay off all craps bets.

4. THE DICE ROLLER CONTROLS THE GAME: Making sure all antes are put into the center square, making sure all card play chip losses are put into the center square and also controls all the chip payouts from the center square. This should be done in rotation, starting with the dice roller.

Since the craps portion of play comes first, all players should be familiar with the basic rules of craps before attempting to learn other rules of craps. By learning and understanding one rule at a time will allow you an opportunity to learn all the rules of craps in an easy and enjoyable way.

BASIC RULES OF CRAPS FOR PLAY

1. One white chip is the maximum bet any player can make on each betting area on the board.

2. PLACE YOUR BETS: Before rolling the dice the dice roller should say "Place your bets". This is to alert the other players that the dice are ready to be rolled. All craps bets must be made before the dice are rolled. The dice roller must place a chip on the pass line, this is called a pass line bet. Other players can also make pass line bets and other craps wagers but do not have to.

3. THE DICE ROLLER WINS BY DOING THE FOLLOWING:

A. On the first roll of the dice (called the come out roll), if the total number rolled is a 7 or 11 the dice roller and all other players with pass line bets win. All win bets are paid off with chips from the center square. The dice roller keeps the dice, places another pass line bet and rolls the dice again, just as if starting over again.

B. On the first roll of the dice the number rolled is either a 4, 5, 6, 8, 9 or 10, this is called a pass line number. If this number is repeated on the following rolls of the dice before a 7 is rolled all players with pass line bets win. The dice roller keeps the dice, places another pass line bet and rolls the dice, just as if starting over again. Each time a pass line number is established, the "white pass line marker puck" is placed on the corresponding pass line number. This is done to identify the current pass line number. There are two pucks and they should be placed on opposite sides of the board.

4. THE DICE ROLLER LOSES BY DOING THE FOLLOWING:

A. On the first roll of the dice, if the total number rolled in a 2, 3 or 12 the roller and all other players with pass line bets lose. All losing bets go into the center square. The dice roller keeps the dice, places another pass line bet and rolls the dice, just as if starting over again.

B. On the first roll of the dice if the number rolled is either a 4, 5, 6, 8, 9 or 10, this is called a pass line number. If a 7 is rolled before the pass line number is repeated the dice roller and all other players with pass line bets lose. The dice roller also loses the dice and passes them to the player on the left. Understanding these basic rules allows you an opportunity to play and enjoy real casino craps along with the strategic card play portion.

TOKEN MOVES IN PLAY

Each player is given a colored game mover token. These are placed on the START box in front of each player.

Player or players are eligible to advance their tokens only if they have made a pass line bet. Pass line bets must be made before the dice are rolled.

TOKEN MOVES ARE MADE IF THE FOLLOWING OCCURS

A. On the first roll of the dice (come out roll), a 7 or 11 is rolled, all players with pass line bets can advance their token one box.

B. A player or players who discard all their cards and end the round of play, can advance their token one box. However, the player must have a pending pass line bet in order to advance the token.

It is also possible to advance a token two boxes on one roll of the dice. i.e., A 7 is rolled on the first roll of the dice, this allows for a one box move. However, if that 7 also allows a player an opportunity to discard all cards then this would allow for another move. Remember in order to do this the player must have a pending pass line bet. There are seven token moves on the board in order for a player to reach the center square.

CARD PLAY PORTION

Any time the dice are rolled, starting with the dice roller, all natural cards or total of combination of cards that match the total number thrown on the dice, can be discarded. i.e., The number rolled on the dice is 8, each player can discard all natural 8 cards held and any combination of cards that total 8, such as a (6 card and a 2 card) a (5 card and a 3 card) a (4 card, a 3 card and an ace), et. Refer to the discard chart to determine which cards can be discarded on each roll of the dice. During any roll of the dice, if a player cannot discard a card, then that playing must put one white chip into the center square. If a player can discard, then that player need not put a chip into the center square. If during a round of play a player decides to forfeit the hand being held because the player feels that the hand does not provide a good chance of winning that round of play, the player must put two chips into the center square for each card held in the hand.

REPEAT

On each roll of the dice the players who cannot discard must put one white chip into the center square. On each roll of the dice the players who can discard need not put any chips into the center square.

WINNING ROUND OF PLAY

The round of play ends when a player or players discard all cards held in the playing hand. When the game reaches a round of play that allows a player to discard his remaining card or cards, that round of play continues until each player has an opportunity to discard. If more than one player discards all his cards during that round of play then they share equally in the chips in the center square. All remaining players must put one white chip into the center square for each card left in their playing hand. All craps bets on the board at this time are also put into the center square. All these chips become part of this winning pot.

VARIATIONS OF PLAY

1. ONE WINNER PLAY: All the rules for card play portion apply. However, the first player to discard all cards is the only winner and card play stops here. All remaining players must put one white chip into the center square for each card left in their hand and all craps bets on the board are put into the center square and all these chips also become part of the winning pot.

2. PARTNER PLAY: All rules for card play portion apply. However, partners sit opposite each other and each partner has the option of using one of the other partners card or cards as part of a combination of cards for discarding. i.e., The number rolled on the dice is 8, the first partner to discard has a 6 card, this partner discards the 6 card, hoping the other partner has a 2 card to make for a combination discard. Either partners part of the combination can be one or more cards. If the combination cannot be completed then the partner who threw out the first portion of the combination is penalized two white chips into the center square and must put the discarded card or cards back into the playing hand being held. The other partner is penalized in the normal manner if that partner cannot discard. The round of play ends when a player is able to discard all cards just as in one winner play. When one partner goes out, both partners share equally in the chips in the center square. All remaining players including the other partner, must put one white chip into the center square for each card held in their hand. All craps bets on the board are also put into the center square and these chips also become part of the winning pot.

ELIMINATION OF PLAYERS DURING PLAY

During Regular Play or One Winner Play versions, if a player has lost all chips then that player is eliminated from the game. However, if the player starts a round of play and is depleted of chips during this round of play, the player continues to play until a chip must be put in by that player. At this point the player must go out and forfeit the hand and is also eliminated from that game.

During Partner Play, partners can borrow from each other by filling out a loan receipt slip. These are filled out according to the point value borrowed. i.e., One partner borrows 5 white chips, two red chips and one blue chip, the load receipt slip is made out for 14 points since this is the value of the chips borrowed. A partner can only borrow before a round of play begins. A partner cannot borrow during a round of play and if the player is without chips during the round of play and is forced to put a chip into the center square, that partner must forfeit that hand for that round of play and the other partner must put one white chip into the center square for each card in the forfeited hand. If this cannot be done because of a lack of chips then both partners are eliminated from the game. If this can be done then the partner who needs to borrow chips can do so at the beginning of the next round of play.

At the end of the overall game, if a partner cannot pay back the total loan, then whatever portion of the loan that cannot be paid back is deducted from the overall point value of the partner's chips.

WINNING THE TOTAL GAME

The total game ends when a player's token enters the center square. A token move into the center square "stops" all other game activity. The game ends immediately when a player's token enters the center square. Since all play stops at this point, other players are not allowed to make their token moves and are not allowed to discard.

All outstanding craps bets are lost and the chips put into the center square. All other players must put one white chip into the center square for each card held in their hand. All the chips in the center square are won by the player whose token entered the center square.

Each player or partners (if you are playing partner play) now total the point value of their chips and the player or partners with the most total point value of chips win the overall game.

DISCARD CHART

ACE - Can only be discarded as part of a combination of cards. Ace has a value of 1.

JACKS, QUEENS AND KINGS - Cannot be used as part of combinations. They can only be discarded if the dice roll totals 10, 11, or 12.

| DICE ROLL TOTALS | SINGLE CARD DISCARD | COMBINATION CARDS DISCARD: |
|---|---|---|
| 2 | All - Natural 2's | + As many combinations of cards that total 2 |
| 3 | All - Natural 3's | + As many combinations of cards that total 3 |
| 4 | All - Natural 4's | + As many combinations of cards that total 4 |
| 5 | All - Natural 5's | + As many combinations of cards that total 5 |
| 6 | All - Natural 6's | + As many combinations of cards that total 6 |
| 7 | All - Natural 7's | + As many combinations of cards that total 7 |
| 8 | All - Natural 8's | + As many combinations of cards that total 8 |
| 9 | All - Natural 9's | + As many combinations of cards that total 9 |
| 10 | All - 10, J, Q, & K's | + As many combinations of cards that total 10 |
| 11 | All - J, Q, & K's | + As many combinations of cards that total 11 |
| 12 | All - J, Q, & K's | + As many combinations of cards that total 12 |

CRAPS BETTING ODDS

Some odds have been simplified as opposed to real casino odds.

| CRAPS BET: | PAY OFF ODDS: |
|---|---|
| Pass Line: | Even Money (1 for 1) |
| Field: | Even Money (1 for 1) for numbers 3, 4, 9, 10 or 11. Two for One for number 2 or 12 |
| Big 6 or 8: | Even Money (1 for 1) |
| Place Bets: | Even Money (1 for 1) for numbers 6 or 8. Two for One for numbers 4, 5, 9 or 10. |
| Any Seven: | Four for One (4 for 1) |
| Any craps: | Four for One (4 for 1) |
| Hardways: | Four for One (4 for 1) |
| Horn: | Four for One (4 for 1) |
| Come: | Even Money (1 for 1) |
| Don't Come Bar: | Even Money (1 for 1) |
| Don't Pass Bar: | Even Money (1 for 1) |

ADDITIONAL CRAPS PLAY RULES

The following are additional bets that can be made during the course of the game. The Basic Rules of Craps should be well understood before attempting to learn additional craps play. This will make the progression of learning craps play enjoyable and easy.

These craps plays are in addition to the basic rules explained earlier.

1. FIELD BET: This bet is made by placing a chip in the field area in front of each player. If the dice roller rolls a 2, 3, 4, 9, 10, 11 or 12 you win. If 2 or 12 are rolled on the dice, all field bets gets paid 2 for 1, all other field numbers pay 1 for 1.

2. BIG 6 OR 8: To make this bet you place a chip on the 6 or 8 in the Big 6/8 box on the board. A chip must be placed on one or both. You are betting that the one you bet on will be rolled on the dice before a 7 is rolled. If this happens, you win. This bet pays 1 for 1. If a 7 is rolled before the number you bet on is rolled, then you lose.

3. PLACE BETS: This bet is made by placing a chip on any or all the numbers above the pass line, i.e. 4, 5, 6, 8, 9, 10. This bet is usually made after the dice roller has made his pass line number. You are betting that the number or numbers that you bet on will be rolled before the dice roller rolls a 7. If this happens, you win. If a 7 is rolled before the number or numbers you bet on are rolled, you lose. In real casino craps, the odds on place bets vary depending on which numbers you bet on. In this game, 6 and 8 pay 1 for 1 and 4, 5, 9 and 10 pay 2 for 1.

4. ANY SEVEN: This bet is made by placing a chip on the "ANY SEVEN" area on the board. You are betting that the dice shooter will roll a 7 on the next roll of the dice. This is only a one roll bet. If a 7 is rolled on the next roll of the dice, you win. If it is not, you lose. The payoff is 4 for 1.

5. ANY CRAPS: This bet is made by placing a chip on the "ANY CRAPS" area on the board You are betting that the dice roller will roll a craps (2, 3, or 12) on the next roll of the dice. This is only a one roll bet. If a craps number is rolled on the next roll of the dice, you win. If not, you lose. The payoff is 4 for 1.

6. HARD WAY BETS: This bet is made by placing a chip on the particular hardway bet you wish to make. You are betting the dice roller will roll the number you bet on the hardway. The 4 must be rolled with a 2 and 2. The 6 must be rolled with a 3 and 3. The 8 must be rolled with a 4 and 4. The 10 must be rolled with a 5 and 5. If these numbers are made with any other combination before the above combinations, you lose. You also lose if the dice roller rolls a 7 before rolling your hardway number. The payoff is 4 for 1.

7. HORN BET: This is a four way bet that is made by placing a chip on the HORN area on the board. You are betting that one of those numbers will come out on the next roll of the dice. This is a one roll bet. If any of those numbers are rolled on the next role of the dice, you win whatever odds that number pays. You lose the bets placed on the other numbers. If none of the numbers are rolled, you lose all the bets. In real casino play, the number 2 and 12 pay 30 to 1 and the 3 and 11 pay 15 to 1. In this game, only one chip is placed on the HORN area and the payoff for a win is 4 to 1.

8. COME BET: This is a bet made by placing a chip on the COME area on the board. This bet is made after a pass line number has been established. It is a bet on the next roll of the dice and is handled as a new come out roll and the same rules apply as a come out roll. The bet chip is placed on the line above the pass line number that corresponds to the come out number that was rolled and it is then handled as a new pass line number. This bet can be made before each roll of the dice after a pass line number has already been established by the dice roller.

9. DON'T PASS, BAR: This is a bet made by a player against the dice roller. Players who make don't bets are called "wrong bettors". They are betting that the dice roller will crap out on the come out roll, that is roll a 2 or 3 on the first roll and therefore they would win. BAR means the casino is taking an edge on this bet and if a 12 is rolled on the first roll, it is a standoff. The bettor neither wins nor loses. The wrong bettor is also betting that the dice roller will roll a 7 before repeating the pass line number. If this happens, the wrong bettor is a winner. This bet normally pays even money, 1 for 1. The bet chip is placed on the line to the left of the pass line number.

10. DON'T COME, BAR: This is the same bet as the DON'T PASS, BAR except you are betting against the come bet, that is the next roll of the dice. The bet chip is placed on the line below the new corresponding number.

These are the most common forms of craps play. For a more detailed description, please consult one of the many published books on casino craps.

QUICK REFERENCE GUIDE FOR GAME PLAY

1. PLAYERS ANTE UP: At the beginning of the game and at the beginning of each new round of play. Also, if the center square is out of chips.

2. CRAPS BETS ARE MADE: Whenever the dice roller is going to roll in order to establish a pass line number (come out roll), a pass line bet is one white chip and must be made by the roller before rolling. Other bets on the board can be made but are not required. Other players can make pass line bets or other bets, but are not required to do so.

3. THE DICE ARE ROLLED: Immediately following each roll of the dice, all craps bets are taken care of, in rotation, starting with the dice roller. All winning bets are paid off from chips in the center square and all losing bets go into the center square.

4. TOKEN MOVES ARE NOW MADE: Only player with pass line bets are allowed to advance on the first roll of the dice (come out roll), if a 7 or 11 is rolled. Token advance is one box.

5. CARD DISCARDING BEGINS: Discarding is done in rotation, starting with the dice roller. Players who cannot discard must put one white chip into the center square.

6. ENDING ROUND OF PLAY: A round of play ends when a player discards all cards. Players left with cards in their hand must put one white chip into the center square for each card. All craps bets lose and the chips go into the center square.

7. TOKEN MOVES ARE NOW MADE: If a player discards all cards, that player advances token one box. However, this player must have had a pending pass line bet in order to advance the token.

8. ENDING THE GAME: The total game ends when a player's token enters the center square. At this point, all game play stops immediately. (End of Rules)

The above description of the preferred embodiment of this invention is intended to be illustrative and not limiting. Other embodiments of this invention will be obvious to those skilled in the art in view of the above disclosure.

I claim:

1. Game apparatus for a number of players comprising:

a board having designated thereon a first series of craps playing areas in a repetitive pattern at defined positions around the board for accepting wagering chips by individual players at said defined positions;

craps betting numerals indicia from numeral 2 to numeral 12 marked within said craps playing areas and having a set reward in accordance with game rules;

a pack of conventional poker playing cards an equal number of which are dealable to said number of players;

a pair of dice to be thrown by a player, each die having a plurality of indicia on the faces thereof for determining a winning position when the sum of top surface numbers on said dice when thrown correspond to those marked areas where a wagering chip has been placed by a player and for determining which playing card having a sum generally corresponding to said sum of said top surface numbers on said dice is to be discarded by a player in accordance with game rules.

2. The apparatus of claim 1 further comprising:

a playing marker assignable to each player;

a second series of discretely marked linearly-extending playing areas between said first series of craps playing areas and extending from adjacent a board peripheral edge to a central pot area of said board; and wherein said marker is movable in successive steps along said second series of playing areas from a start position at said board peripheral edge to said central pot area in accordance with game rules.

3. The apparatus of claim 2 in which said board is square and a pair of said second series of playing areas extend from a mid-point of each side of said board to said central pot area such that eight players are accommodated at said board.

4. The apparatus of claim 1 in which said board further includes indicia indicative of other craps wagers in said playing areas.

5. The apparatus of claim 1 further including a central pot area on said board having an outer periphery bounded on all sides by said first series of craps playing areas.

6. Game apparatus for a number of players comprising:

a game board having a repetitive set of multiple craps wagering areas in each of four quadrants of said board;

craps wagering indicia in each of said wagering areas;

a pack of poker playing cards an equal number of which are dealable to said number of players;

indicia on said playing cards indicative of the numbers 1 through 12 in accord with game rules;

a pair of dice to be thrown by a player, each die having a plurality of number indicia on the faces thereof; and a series of token spaces extending between each set of said craps wagering areas from a peripheral area of said board to a central area of the board common to each of said craps wagering areas.

7. The apparatus of claim 6 in which said series of token spaces include a pair of side-by-side space ladders for utilization by two players.

8. A board game comprising:

a flat game board having a playing surface on an upper surface thereof;

a first series of repetitive craps wagering areas on said playing surface positioned to have a craps wagering area in front of each player;

a center area on said playing surface for receiving antes and lost wagers;

a series of token ladders extending between each of said craps wagering areas from a peripheral area of said playing surface opposite each player to said center area; and wherein said game further comprises a pair of dice and a deck of poker playing cards and wherein said pair of dice are thrown to indicate a successful or unsuccessful wager in said craps wagering areas, dealt cards from said deck of poker playing cards are discarded by card values corresponding to the sum of indicia appearing on the top of said thrown dice and a token is moved on said token ladders to said central area in accord with game rules.

9. Game apparatus for a number of players comprising:

a board having designated thereon a first series of discretely marked playing areas for accepting a wagering chip;

craps betting numerals indicia from numeral 2 to numeral 12 printed within said areas and having a set reward in accordance with game rules;

a pack of conventional poker playing cards an equal number of which are dealable to said number of players;

a pair of dice to be thrown by a player, each die having a plurality of indicia on the faces thereof;

wherein the sum of top surface numbers on said dice when thrown are indicative of a winning position at a set reward on those marked areas where a chip has been placed by a player and indicative of at least one playing card having a sum generally corresponding to said sum of said top surface numbers on said dice, said at least one card to be discarded by a player in accordance with game rules;

a playing marker assignable to each player;

a second series of discretely marked linearly-extending playing areas between said first series of marked playing areas and extending from adjacent a board peripheral edge to a central pot area of said board; and wherein said marker is movable in successive steps along said second series of playing areas from a start position at said board peripheral edge to said central pot area in accordance with game rules.

10. The apparatus of claim 9 in which said board is square and a pair of said second series of playing areas extend from a mid-point of each side of said board to said central pot areas such that eight players are accommodated at said board.

* * * * *